US009376995B2

(12) United States Patent
Ryoo

(10) Patent No.: US 9,376,995 B2
(45) Date of Patent: Jun. 28, 2016

(54) FUEL SUPPLY APPARATUS FOR GDI ENGINE HAVING REDUCED PRESSURE PULSATION

(71) Applicant: Hyundai Motor Company, Seoul (KR)

(72) Inventor: Dongmyoung Ryoo, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 814 days.

(21) Appl. No.: 13/681,112

(22) Filed: Nov. 19, 2012

(65) Prior Publication Data

US 2013/0333672 A1 Dec. 19, 2013

(30) Foreign Application Priority Data

Jun. 14, 2012 (KR) ..... 10-2012-0063722

(51) Int. Cl.
*F02M 55/00* (2006.01)
*F02M 37/00* (2006.01)
*F02M 55/04* (2006.01)

(52) U.S. Cl.
CPC ..... *F02M 55/007* (2013.01); *F02M 37/0041* (2013.01); *F02M 55/04* (2013.01)

(58) Field of Classification Search
CPC ..... F02M 63/024; F02M 69/26; F02M 55/04; F02M 55/007; F02M 37/0041; F02M 37/0052; F02M 37/0058
See application file for complete search history.

(56) References Cited

U.S. PATENT DOCUMENTS 3,910,724 A * 10/1975 Okamoto ..... F02D 1/00 123/449
4,118,156 A * 10/1978 Ivosevic ..... F02M 55/04 123/511
5,624,072 A * 4/1997 Okajima ..... F02M 41/1405 239/124
6,053,712 A * 4/2000 Konishi ..... F02M 63/0225 123/446
6,065,453 A * 5/2000 Zych ..... F02M 55/001 123/506
6,209,525 B1 * 4/2001 Konishi ..... F02M 55/04 123/458
6,901,912 B1 * 6/2005 Onishi ..... F02M 55/04 123/447
7,624,720 B1 * 12/2009 Dokas ..... F02M 63/0052 123/457
2009/0068041 A1 * 3/2009 Beardmore ..... F02M 55/04 417/540
2010/0212639 A1 * 8/2010 Nakane ..... F02M 37/0041 123/511
2011/0297253 A1 * 12/2011 Akagi ..... F02M 37/0029 137/511

(Continued)

FOREIGN PATENT DOCUMENTS

JP 2000-291509 A 10/2000
JP 2006-132439 A 5/2006
JP 2006-348956 A 12/2006

(Continued)

*Primary Examiner* — Hieu T Vo
*Assistant Examiner* — Sherman Manley
(74) *Attorney, Agent, or Firm* — Morgan, Lewis & Bockius LLP

(57) ABSTRACT

A fuel supply apparatus for a Gasoline Direct Injection (GDI) engine having reduced pressure pulsation includes low and high pressure fuel pumps, connected via a fuel supply line, a pressure sensor and a pulsation relief valve installed between the pressure sensor and the high pressure fuel pump. The pulsation relief valve includes a check valve part allowing the fuel to flow in a normal direction from the low pressure fuel pump to the high pressure fuel pump but not in a reverse direction, and an orifice part which is installed substantially in parallel to the check valve part and is configured to allow the fuel to flow in both directions, wherein an amount of the fuel flowing through the orifice part is less than an amount of the fuel flowing through the check valve part in the normal direction.

9 Claims, 7 Drawing Sheets

(56) References Cited

U.S. PATENT DOCUMENTS

| | | | | |
|---|---|---|---|---|
| 2012/0073546 | A1* | 3/2012 | Blom | B08B 9/00 123/506 |
| 2015/0152829 | A1* | 6/2015 | Koenig | F02M 63/0001 123/495 |

FOREIGN PATENT DOCUMENTS

| | | | |
|---|---|---|---|
| JP | 3947071 | B2 | 4/2007 |
| JP | 2008-303852 | A | 12/2008 |
| JP | 2009-79564 | A | 4/2009 |
| KR | 10-2009-0028860 | A | 3/2009 |

* cited by examiner

FUEL SUPPLY APPARATUS FOR GDI ENGINE HAVING REDUCED PRESSURE PULSATION

CROSS-REFERENCE(S) TO RELATED APPLICATIONS

The present application claims priority of Korean Patent Application Number 10-2012-0063722, filed on Jun. 14, 2012, the entire contents of which application are incorporated herein for all purposes by this reference.

BACKGROUND OF INVENTION

1. Field of Invention

The present invention relates to a fuel supply apparatus for a Gasoline Direct Injection (GDI) engine, and particularly to a fuel supply apparatus for a GDI engine having reduced pressure pulsation which makes it possible to reduce pressure pulsation occurring in a high pressure fuel pump with the aid of a low pressure fuel pump of a fuel supply apparatus of a GDI engine which operates with a variable fuel pressure.

2. Description of Related Art

In a Gasoline Direct Injection (GDI) engine, when a low pressure fuel pump installed in a fuel tank supplies fuel to a high pressure fuel pump installed in an engine, the high pressure fuel pump pressurizes the fuel, and the pressurized fuel is sprayed from an injector of a cylinder.

Referring to FIG. 1, an example of a conventional fuel supply apparatus for a GDI engine will be described. The conventional fuel supply apparatus for a GDI engine includes a low pressure fuel pump 21 which is installed at one side of a fuel tank 10 and works with a fixed fuel pressure, and a high pressure fuel pump 31 which is mounted on an engine and supplies a high pressure fuel to the injector. On a fuel supply line 40 connecting both the low pressure fuel pump 21 and the high pressure fuel pump 31 is installed a regulator 41 which is configured to return fuel to the fuel tank 10. With the above mentioned construction, the fuel supplied from the low pressure fuel pump 21 except for the fuel which is sprayed to the injector via the high pressure fuel pump 31 is returned to the fuel tank 10 via the regulator 41.

In addition, at the low pressure fuel pump 21 is disposed a check valve 21*a* for the purpose of preventing the fuel supplied from the low pressure fuel pump 21 to the fuel supply line 40 from flowing in a reverse direction. At one side of the fuel tank 10 is disposed a suction jet pump 12. The fuel residing at the other side of the fuel tank 10 to be transferred as part of the fuel discharged from the low pressure fuel pump 21 forms a negative pressure while it is passing through an orifice. And at the other side of the fuel tank 10 is disposed a suction sub filter 11 for the purpose of filtering impurities contained in the fuel which is supplied to the suction jet pump 12.

The regulator 41 is installed at a downstream of the low pressure fuel tank 21 which discharges fuel with a fixed fuel pressure and is configured to open when a pressure pulsation exceeds a previously set discharge fuel pressure of the low pressure fuel pump 21.

When the pressure pulsation occurring in the high pressure fuel pump 31 is transferred to the low pressure fuel pump 21 along the fuel supply line 40, the regulator 41 opens and enables the fuel to return to the fuel tank 10 thereby eliminating pressure pulsation.

As shown in FIG. 2, a system is disclosed recently, which is configured to enable a low pressure fuel pump 21 to discharge fuel with a variable fuel pressure depending on the fuel pressure which is variably determined by the ECU (Electronic Control Unit) 51 based on the operation condition of an engine.

A relief valve 42 is installed on the fuel supply line 40 connecting both the low pressure fuel pump 21 installed in the fuel tank 10 and the high pressure fuel pump 31 installed at the engine 30, and a pressure sensor 43 is installed between the low pressure fuel pump 21 and the relief valve 42. The fuel pressure measured by the pressure sensor 43 is outputted to the ECU 51, and the ECU 51 is configured to set a target fuel pressure and to control the low pressure fuel pump 21 by way of a fuel pump controller 52. The relief valve 42 opens and allows fuel to bypass only when the pressure level of the fuel supply line 40 is over a preset pressure under the abnormal situations that a pressure pulsation occurs in the high pressure fuel pump 31 or a filter is blocked.

In the above described construction, since the relief valve 42 remains being closed when the pressure pulsation occurring in the high pressure fuel pump 31 is below the operation pressure of the relief valve 42, it is impossible to eliminate a pressure pulsation.

Since the pressure pulsation is not eliminated, the pressure sensor 43 disposed between the relief valve 42 and the high pressure fuel pump 31 on the fuel supply line 40 could continue computing inaccurate values. In other words, when pulsation occurs due to the pressure in the high pressure pump 31, the pressure sensor 43 computes or measures, as pressure value of the fuel supply line 40, the duplicated values of the fuel pressure of the low pressure fuel pump 21 and the pressure pulsation transferred from the high pressure fuel pump 31, and thus the inaccurately measured pressure values are transferred to the ECU 51. The ECU 51 transfers the target fuel pressure determined from the inaccurate values to the controller 52, and the controller 52 comes to control the operations of the low pressure fuel pump 21 so that an incorrectly determined target fuel pressure is obtained.

As the pressure pulsation of the fuel supply line 40 is continuously measured by means of the pressure sensor 43, the fuel pressure keeps varying, so there will be a large difference between the target fuel pressure and the actual fuel pressure. As pulsation increases in the actual fuel pressure, the fuel pressure feedback control of the fuel pump controller 52 becomes defective.

In addition, as the pressure pulsation increases in the fuel supply line 40, pulsation sounds are generated, and the feedback control of the fuel pressure becomes poor, so engine operation problems such as a defective engine start, an engine stop, a non-uniform engine operation occur in the conventional art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to provide an improved fuel supply apparatus for a GDI engine having reduced pressure pulsation which includes a pulsation relief valve between a pressure sensor and the side of an engine so that a pressure sensor is not influenced from a pressure pulsation in a fuel supply apparatus of a GDI engine, where pressure pulsation occurs at the side of an engine.

Various aspects of the present invention provide a fuel supply apparatus for a Gasoline Direct Injection (GDI)

engine having reduced pressure pulsation. The fuel supply apparatus may include a low pressure fuel pump installed at one side of a fuel tank, a high pressure fuel pump installed in the engine and connected with the low pressure fuel pump via a fuel supply line, a pressure sensor which is configured to measure a fuel pressure of the fuel supply line between the low pressure fuel pump and the high pressure fuel pump and output to an ECU (Electronic Control Unit) and a pulsation relief valve which is installed between the pressure sensor and the high pressure fuel pump. The pulsation relief valve includes a check valve part which is configured to allow the fuel to flow in a normal direction from the low pressure fuel pump to the high pressure fuel pump but not in a reverse direction from the high pressure fuel pump to the low pressure fuel pump, and an orifice part which is installed substantially in parallel to the check valve part and is configured to allow the fuel to flow in both directions, wherein an amount of the fuel flowing through the orifice part is less than an amount of the fuel flowing through the check valve part in the normal direction.

One aspect of the present invention provides a pulsation relief valve that may be positioned downstream at the front end of the pressure sensor. The pulsation relief valve may be configured to relieve pressure pulsation transferred from the high pressure fuel pump as the check valve part is partially open when pulsation occurs from the high pressure fuel pump while the low pressure fuel pump is being operated, or to interrupt a pressure pulsation transferred from the high pressure fuel pump as the check valve part is fully closed. In addition, the pulsation relief valve may be configured to block the flow of fuel in both directions when the engine is stopped.

Another aspect of the present invention provides the pulsation relief valve that may be configured to allow the check valve part to open to a maximum level when pressure pulsation does not occur in the high pressure fuel pump while the low pressure fuel pump and the high pressure fuel pump are being operated, so the fuel is transferred from the low pressure fuel pump to the high pressure fuel pump by way of the check valve part and the orifice part.

In addition, the pulsation relief valve may be configured to allow the fuel pressurized in the fuel supply line to pass through only the orifice part in a direction from the high pressure fuel pump to the low pressure fuel pump and bypassing to the fuel tank by way of a relief valve, wherein the relief valve is configured to open when the pressure of the fuel supply line between the low pressure fuel pump and the pressure sensor is higher than a preset opening pressure of the relief valve, thereby allowing the fuel to return to the fuel tank so the pressure of the fuel supply line is lowered. The opening pressure of the relief valve may be set higher than a discharge pressure range of the low pressure fuel pump.

Yet another aspect of the present invention provides a fuel supply apparatus for a GDI engine having reduced pressure pulsation that may further includes a check valve. The check valve may be installed at an outlet of the low pressure fuel pump, wherein the opening pressure of the relief valve may be set higher than an opening pressure of the check valve which allows the check valve to open, and the opening pressure of the check valve may be set higher than the opening pressure of the pulsation relief valve which allows the check valve part of the pulsation relief valve to open.

Still another aspect of the present invention provides a fuel supply apparatus for a GDI engine having reduced pressure pulsation that may further includes a controller. The controller may be installed between the ECU and the low pressure fuel pump, wherein the ECU may be configured to compare a current fuel pressure measured by the pressure sensor with a target fuel pressure of the fuel supply line which is measured by the ECU, and to output the target fuel pressure to the controller, so the controller controls a pressure of the fuel which is discharged from the low pressure fuel pump.

According to the fuel supply apparatus for a GDI engine having reduced pressure pulsation of the present invention, the pressure pulsation occurring in a high pressure fuel pump at the side of an engine is reduced with the aid of a pulsation relief valve or is prevented in the course of the operations of an engine, so the pulsation noises occurring due to pressure pulsation can be reduced.

The feedback control can be enhanced, and the actual fuel pressure measured by the pressure sensor is close to the target fuel pressure in the ECU, so a variable pressure control performance can be enhanced, and engine operation problems such as a defective engine start, an engine stop, a non-uniform engine operation can be prevented, thus enhancing the operations of an engine.

In the present invention, as a high pressure fuel in a high pressure fuel pump slowly passes through in a reverse direction a pulsation relief valve just after the engine stops and returns to a fuel tank via a relief valve for eliminating the residual pressure of a fuel supply line, it is possible to prevent a fuel supply line from being broken by means of a residual pressure.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
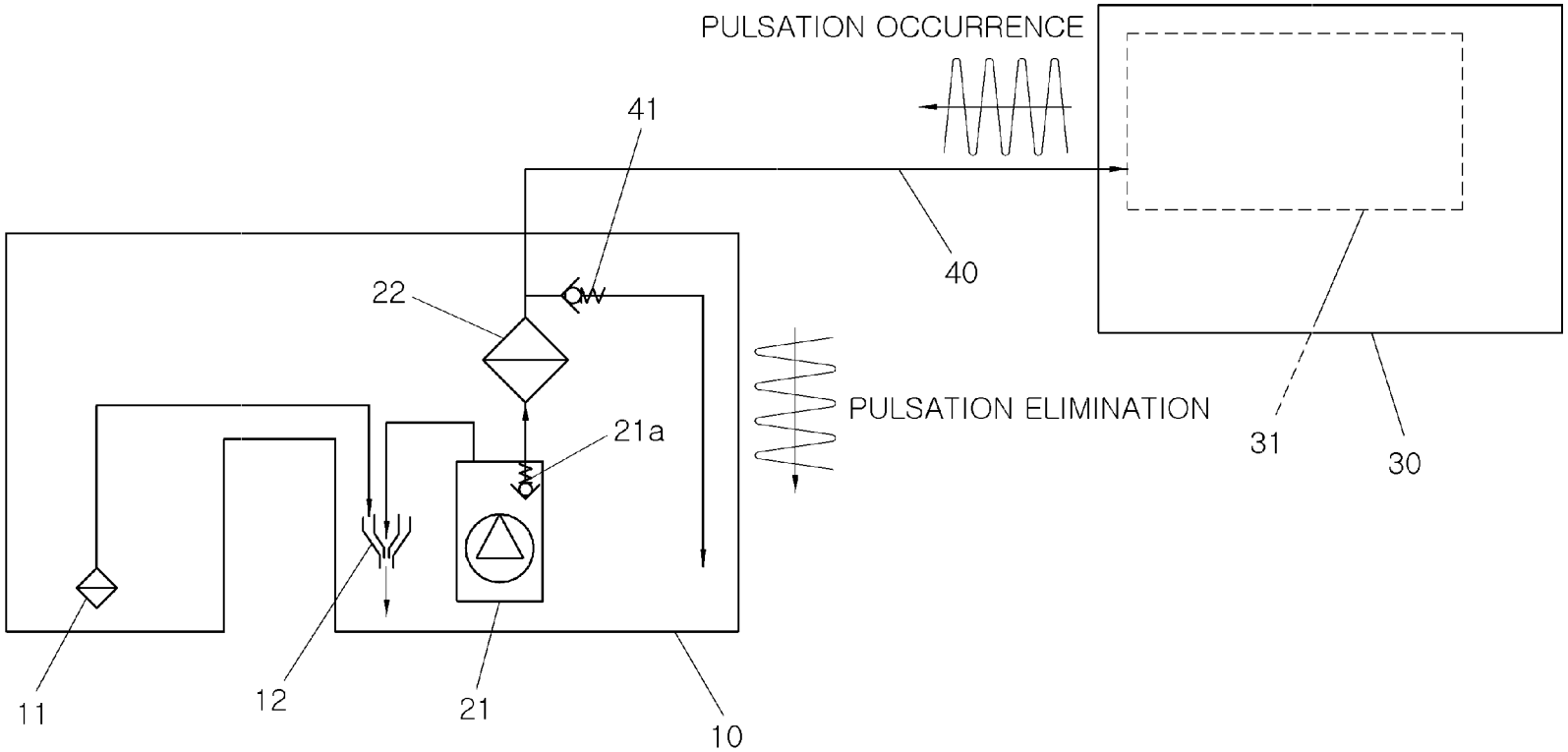
FIG. 1 (Prior Art)
FIG. 1 is a block diagram illustrating a conventional fuel supply apparatus for a GDI engine.
Figure 2:
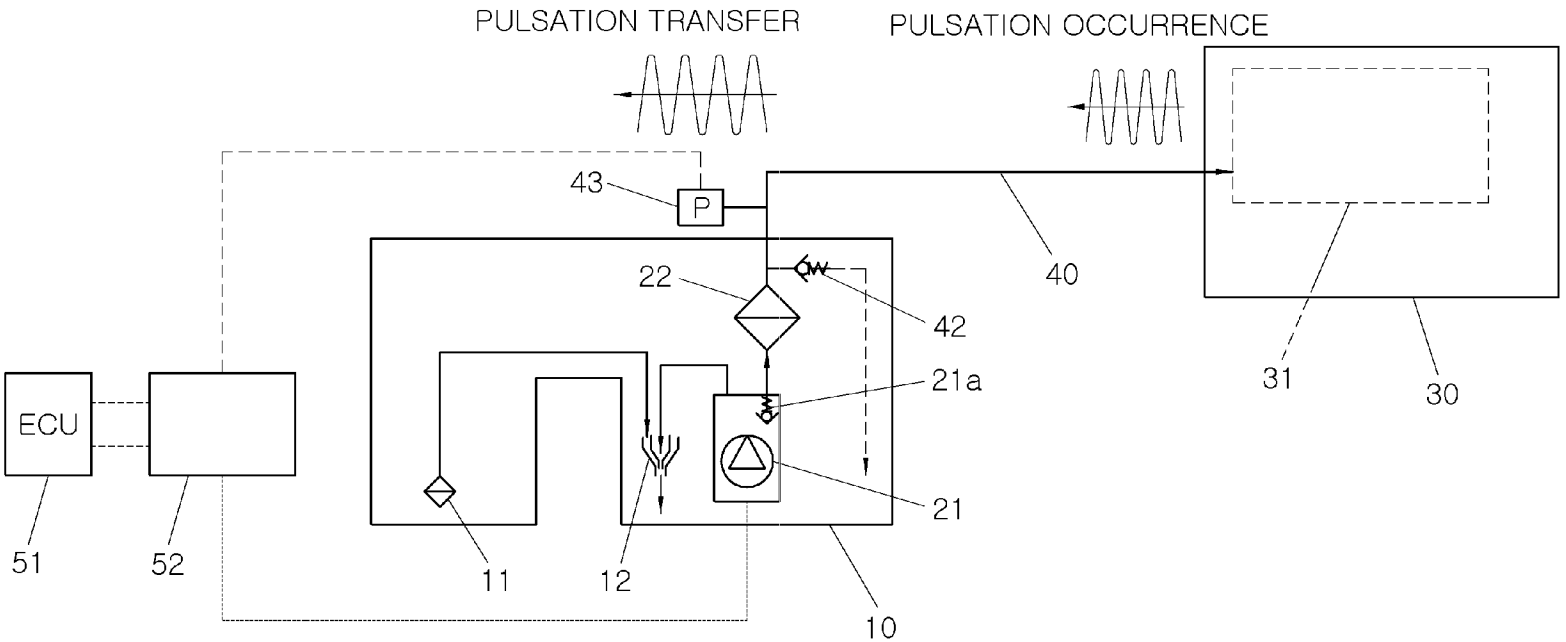
FIG.2 (Prior Art)
FIG. 2 is a block diagram illustrating another conventional fuel supply apparatus for a GDI engine.
Figure 3:
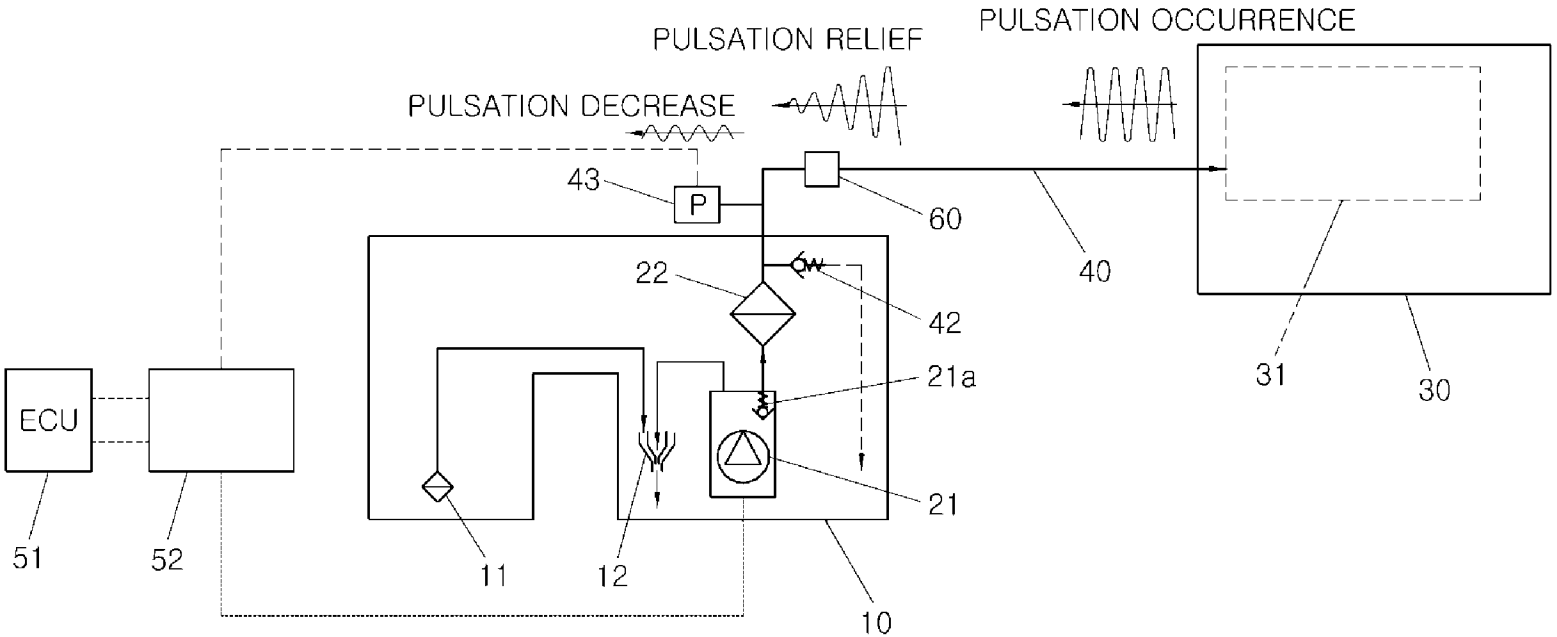
FIG. 3 is a block diagram illustrating an exemplary fuel supply apparatus for a GDI engine having reduced pressure pulsation according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The fuel supply apparatus for a Gasoline Direct Injection (GDI) engine having reduced pressure pulsation according to the present invention includes a pulsation relief valve 60 which is disposed between a low pressure fuel pump 21 and a high pressure fuel pump 31. The fuel supply apparatus is configured to supply fuel to a GDI engine.

The low pressure fuel pump 21 is installed at one side of the fuel tank 10 and is configured to discharge the fuel stored in the fuel tank 10 to the outside of the fuel tank 10. The low pressure fuel pump 21 is controlled by means of a controller 52. The controller 52 controls the low pressure fuel pump 21 to discharge fuel with a variable fuel pressure depending on the target fuel pressure determined by the ECU 51 and transferred from the ECU 51. At an outlet of the low pressure fuel pump 21 is installed a check valve 21*a* for thereby preventing fuel from flowing in a reverse direction. Part of the fuel discharged while the low pressure fuel pump 21 is being operated is transferred to a suction jet pump 12 installed at one side of the fuel tank 10, and the fuel of the other side of the fuel tank passes through a suction sub-filter 11 with the aid of a negative pressure in the interior of the suction jet pump 12 and is transferred to one side of the fuel tank 10.

The high pressure fuel pump 31 is installed at one side of the engine 30 and is configured to pressurize the fuel transferred from the low pressure fuel pump 21 and to supply it to the injector.

The low pressure fuel pump 21 and the high pressure fuel pump 31 are connected by way of the fuel supply line 40, and on the fuel supply line 40 is installed a relief valve which remains closed at usual time, but when the pressure of the fuel supply line 40 increases above a preset value due to an abnormal situation such as a control problem or a blocked filter, it opens and allows the fuel to bypass the fuel tank 10. The relief valve 42 is installed between the low pressure fuel pump 21 and the high pressure fuel pump 31 and is configured in such a way that the opening pressure of the relief valve 42 exceeds the discharge pressure range of the low pressure fuel pump 21. If the control fuel pressure of the low pressure fuel pump 21 is in the range of 2.5~6 bar, the opening pressure of the relief valve 42 can be set above 7 bar.

Between the low pressure fuel pump 21 and the relief valve 42 is disposed a pressure sensor 43 which is configured to measure the pressure of the fuel supply line 40 for the purpose of a control of the low pressure fuel pump 21. The pressure sensor 43 is configured to output the pressure of the fuel supply line 40 to the ECU 51.

The ECU 51 is configured to determine a target pressure of the fuel discharged from the low pressure fuel pump 21 with the aid of the pressure of the fuel supply line 40 measured by means of the pressure sensor 43 and to transfer the determined target pressure of the fuel to the controller 52.

The controller 52 controls the low pressure fuel pump 21 to discharge fuel with the target fuel pressure determined by the ECU 51 in such a way as to control the voltage, revolution, and/or other parameters of the low pressure fuel pump 21.

In the fuel supply apparatus of the GDI engine, since the high pressure fuel pump 31 operates while ensuring that the fuel can be discharged at a high pressure, for example, at 20~150 bar as compared with the low pressure fuel pump 21, pressure pulsation occurs when the high pressure fuel pump 31 is being operated. When the pressure pulsation is transferred to the pressure sensor, the earlier described problems occur.

A certain means is disposed between the low pressure fuel pump 21 and the high pressure fuel pump 31 for the purpose of preventing the pulsation in pressure, thus ensuring that the transfer of a pressure pulsation occurring due to the operation of the high pressure fuel pump 31 can be prevented.

As a pressure pulsation prevention means, various embodiments of the present invention provide a pulsation relief valve 60 which is installed at a downstream of the pressure sensor 43, for example, may be installed between the pressure sensor 43 and the high pressure fuel pump 31 or at the portion past the pressure sensor 43 from the direction that the fuel flows in a normal direction and which is installed near the pressure sensor 43, so the pressure pulsation occurring in the high pressure fuel pump 31 can be prevented from transferring to the pressure sensor 43.

Figure 4:
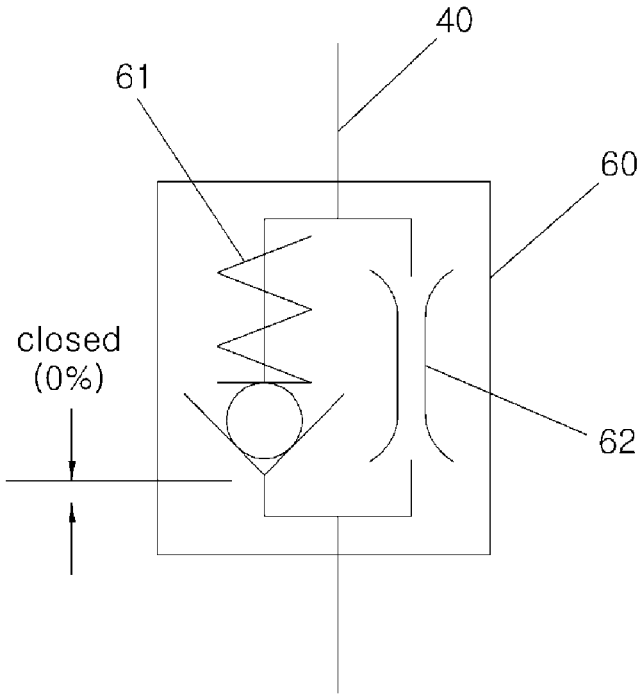
FIG. 4 is a block diagram illustrating a construction of an exemplary pulsation relief valve adapted to a fuel supply apparatus for a GDI engine having reduced pressure pulsation according to the present invention.

Referring to FIG. 4, the construction of an exemplary pulsation relief valve 60 according to various embodiments of the present invention will be described. The pulsation relief valve 60 includes a check valve part 61 which is configured to allow the fuel to bypass from the low pressure fuel pump 21 to the high pressure fuel pump 31 and not to bypass in the opposite direction, and an orifice part 62 which is installed substantially in parallel to the check valve 61.

Since the check valve part 61 allows the fuel to pass through from the low pressure fuel pump 21 to the high pressure fuel pump 31 and not to pass though in the revere direction (from the high pressure fuel pump to the low pressure fuel pump), enough fuel can be supplied from the low pressure fuel pump 21 to the high pressure fuel pump 31 in the normal operation mode.

The orifice part 62 is configured to allow the fuel to flow in both directions; however the amount of the fuel passing through the orifice part 62 is smaller as compared with the flow amount of the fuel which flows in the normal direction (from the low pressure fuel pump to the high pressure fuel pump) of the check valve 61.

Since the check valve part 61 and the orifice part 62 are installed substantially in parallel to each other, enough fuel can be transferred from the low pressure fuel pump 21 to the high pressure fuel pump 31 with the aid of the check valve part 61 and the orifice part 62 in the normal operation mode, and when pressure pulsation occurs, only a small amount of fuel is allowed to flow from the high pressure fuel pump 31 and the low pressure fuel pump 21 only via the orifice part 62.

The pulsation relief valve 60 reduces or prevents the pressure pulsation which is transferred from the high pressure fuel pump 31 to the low pressure fuel pump 21 by way of the pulsation relief valve 60, and the pressure in the fuel supply line 40 between the pulsation relief valve 60 and the high pressure fuel pump 31 can be relieved by way of the orifice part 62.

At the low pressure fuel pump 21 is disposed a check valve 21*a* for the purpose of preventing the discharged fuel from flowing in a reverse direction, and at one side of the pulsation relief valve 60 is a check valve part 61, and there is provided a relief valve 42 which allows the fuel to bypasses from the fuel supply line 40 to the fuel tank 10. The pressure-related operations of them are as follows. The opening pressure of the relief valve which helps open the relief valve 42 is set high enough to exceed the opening pressure of the check valve which helps open the check valve 21*a*, and the opening pressure of the check valve is set high enough to exceed the opening pressure of the pulsation relief valve which helps open the check valve part 61 of the pulsation relief valve 60. In other words, the opening pressure of the relief valve 42 is the highest, and the check valve 21*a* and the pulsation relief valve 60 follow in order. Since the opening pressure of the relief valve is over the opening pressure of the check valve, when the pressure of the interior of the fuel supply line 40 increases, the fuel returns to the fuel tank 10 via the relief valve 42. Since the opening pressure of the check valve is set higher than the opening pressure of the pulsation relief valve, the fuel discharged from the low pressure fuel pump 21 is transferred to the high pressure fuel pump 21 by way of the pulsation relief valve 60.

The operations of the fuel supply apparatus for a GDI engine having reduced pressure pulsation will be described below.

The pulsation relief valve operates as shown in FIGS. 4 to 7 in the fuel supply apparatus for a GDI engine having reduced pressure pulsation according to various embodiments of the present invention.

FIG. 4 is a view before the engine starts. Since the low pressure fuel pump 21 and the high pressure fuel pump 31 are not in operations, there are no flows of the fuel by way of the check valve part 61 and the orifice part 62, so no fuel flows by way of the pulsation relief valve 60.

Figure 5:
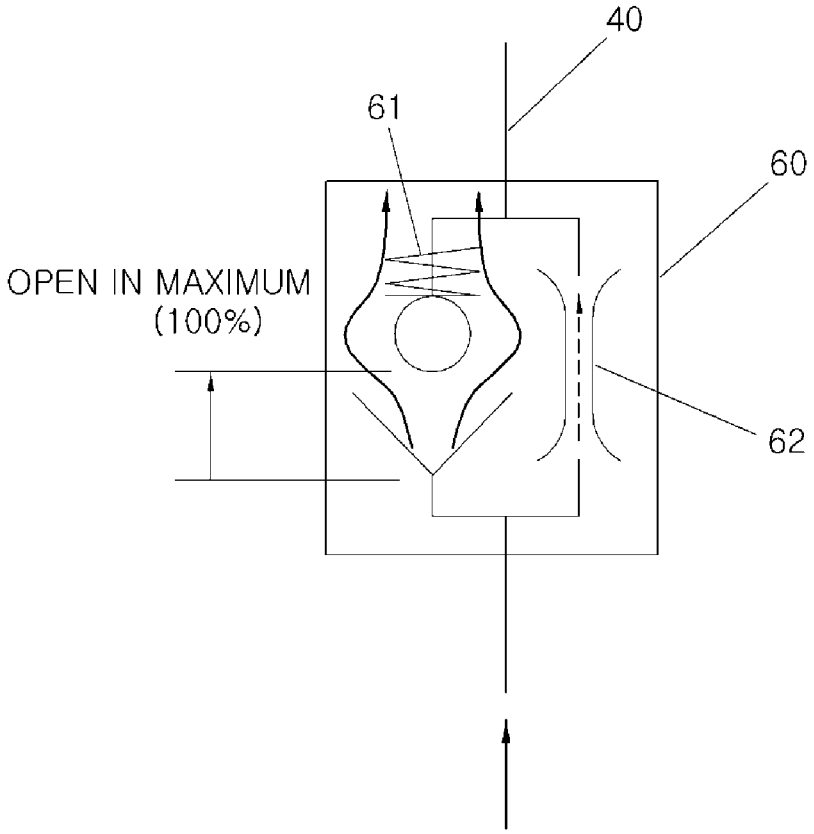
FIGS. 5 to 7 are block diagrams illustrating the operation states of the exemplary pulsation relief valve of FIG. 4.
Figure 6:
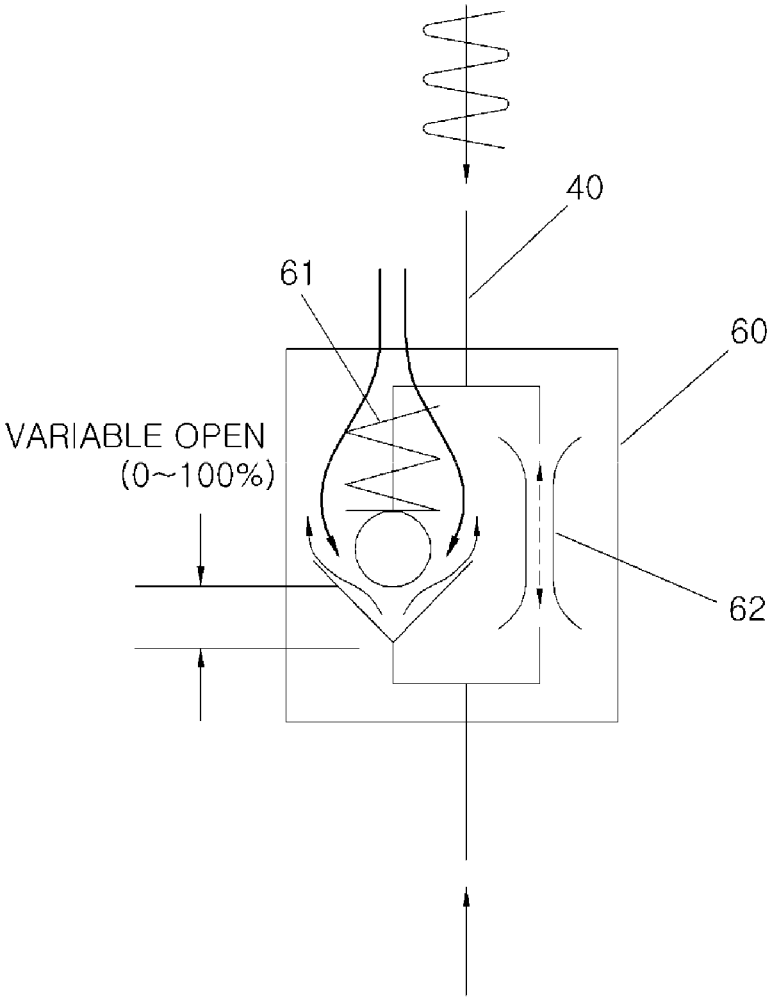

FIGS. 5 and 6 are views illustrating a state of the pulsation relief valve 60 when the low pressure fuel pump 21 and the high pressure fuel pump 31 operates to drive the engine, of which FIG. 5 is a view illustrating a state that the pulsation relief valve 60 when pulsation does not occur, and FIG. 6 is a view illustrating a state that the pulsation relief valve 60 when pulsation occurs.

When pressure pulsation does not occur (as shown in FIG. 5), the fuel discharged from the low pressure fuel pump 21 is transferred to the high pressure fuel pump 31 by way of the check valve 61 and the orifice part 62 and then is pressurized by the high pressure fuel pump 31 and is sprayed via the injector. When pressure pulsation does not occur at the side of the high pressure fuel pump 31, the check valve part 62 opens in maximum and allows the fuel to bypass.

When pressure pulsation occurs (as shown in FIG. 6), the pressure helping supply the fuel from the low pressure fuel pump 21 to the high pressure fuel pump 31 and the pressure pulsation transferred from the high pressure fuel pump 31 are applied to the pulsation relief valve 60 in the opposite directions. Here, the pressure pulsation occurring from the side of the high pressure fuel pump 31 is applied in the direction of the opening degree of the check valve part 61 decreases, the opening degree of the check valve part 61 decreases, and the amount of fuel transferred by way of the orifice part 62 decreases, so the pressure pulsation is prevented from being transferred to the pressure sensor 43. When the discharge pressure of the low pressure fuel pump 21 is higher than the pressure pulsation transferred from the high pressure fuel pump 31, the fuel is supplied from the low pressure fuel pump 21 to the high pressure fuel pump 31 with the opening degree of the check valve part 61 being low by means of the pressure transferred from the high pressure fuel pump 31, and the opening level of the check valve part 61 is determined by means of the pressure difference between the low pressure fuel pump 21 and the high pressure fuel pump 31.

Due to the pressure pulsation, when the pressure applied to the low pressure fuel pump 21 is higher than the pressure discharged from the low pressure fuel pump 21 to the high pressure fuel pump 31, the check valve 61 is closed, and a small amount of fuel is transferred from the high pressure fuel pump 31 to the low pressure fuel pump 21 as it passes through the orifice part 62, so the pressure is relieved. Consequently, the pulsation relief valve 60 relieves the pressure pulsation which occurs at the side of the high pressure fuel pump 31.

Figure 7:
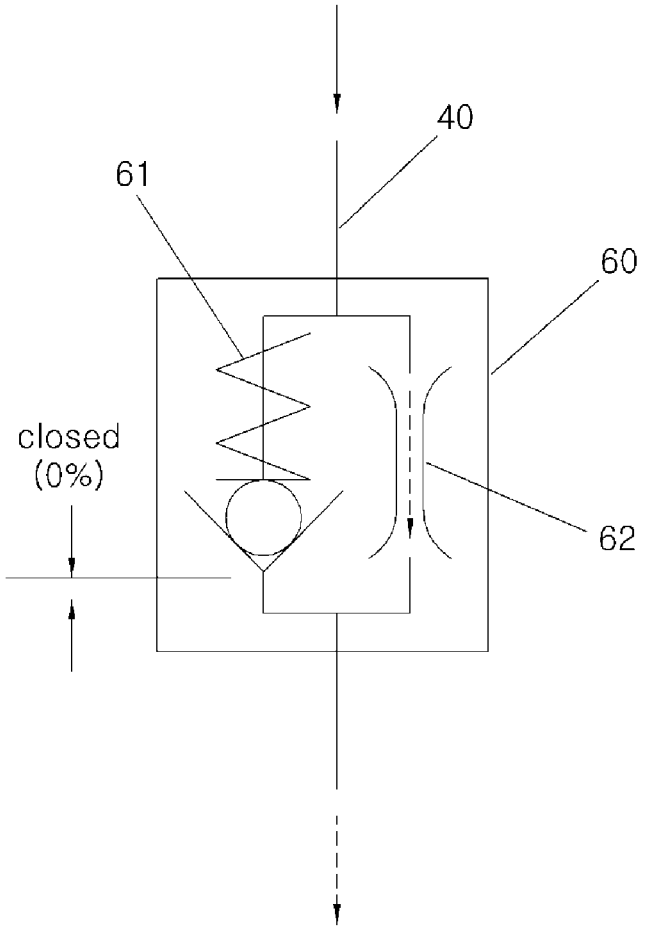

As shown in FIG. 7, just after the engine stops, the discharge of the fuel from the low pressure fuel pump 21 to the high pressure fuel pump 31 is stopped, so the residual pressure of the fuel of the high pressure fuel pump 31 is applied from the high pressure fuel pump 31 to the low pressure fuel pump 21. Just after the engine is stopped, a high pressure fuel is transferred to the low pressure fuel pump 21 for a pressure relief of the high pressure fuel pump 31. Since the check valve part 61 is closed, the fuel at the side of the high pressure fuel pump 31 slowly passes through the pulsation relief valve 60 by way of the orifice part 62 in the reverse direction (from the high pressure fuel pump to the low pressure fuel pump) and moves to the side of the relief valve 42, so the pressure is relieved as the relief valve 42 is opened. As described above, since the pressure can be relieved just after the engine 30 has stopped, it is possible to prevent the fuel supply line 40 from being broken by the pressurized fuel.

For convenience in explanation and accurate definition in the appended claims, the terms "higher" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel supply apparatus for a Gasoline Direct Injection (GDI) engine having reduced pressure pulsation, the fuel supply apparatus comprising:

a low pressure fuel pump installed at one side of a fuel tank;

a high pressure fuel pump installed in the engine and connected with the low pressure fuel pump via a fuel supply line;

a pressure sensor which is configured to measure a fuel pressure of the fuel supply line between the low pressure fuel pump and the high pressure fuel pump and output to an Electronic Control Unit (ECU); and a pulsation relief valve which is installed between the pressure sensor and the high pressure fuel pump, wherein the pulsation relief valve comprises:

a check valve part mounted on the fuel supply line between the pressure sensor and the high pressure fuel pump and configured to allow the fuel to flow in a forward direction from the low pressure fuel pump to the high pressure fuel pump but not in a reverse direction from the high pressure fuel pump to the low pressure fuel pump, and an orifice part mounted on the fuel supply line between the pressure sensor and the high pressure fuel pump and installed substantially in parallel to the check valve part wherein the orifice part is configured to allow the fuel to flow in forward and reverse directions, and wherein an amount of the fuel flowing through the orifice part is less than an amount of the fuel flowing through the check valve part in the forward direction, wherein the pulsation relief valve is configured to allow the fuel pressurized in the fuel supply line to pass through only the orifice part in a direction from the high pressure fuel pump to the low pressure fuel pump.

2. The fuel supply apparatus for a GDI engine having reduced pressure pulsation according to claim 1, wherein the pulsation relief valve is positioned downstream of a front end of the pressure sensor.

3. The fuel supply apparatus for a GDI engine having reduced pressure pulsation according to claim 1, wherein the pulsation relief valve is configured to relieve pressure pulsation transferred from the high pressure fuel pump as the check valve part is partially open when pulsation occurs from the high pressure fuel pump while the low pressure fuel pump is being operated, or to interrupt a pressure pulsation transferred from the high pressure fuel pump as the check valve part is fully closed.

4. The fuel supply apparatus for a GDI engine having reduced pressure pulsation according to claim 1, wherein the check valve part of the pulsation relief valve is configured to block a flow of fuel in forward and reverse directions when the engine is stopped.

5. The fuel supply apparatus for a GDI engine having reduced pressure pulsation according to claim 1, wherein the pulsation relief valve is configured to allow the check valve part to open to a maximum level when pressure pulsation does not occur in the high pressure fuel pump while the low pressure fuel pump and the high pressure fuel pump are being operated, so the fuel is transferred from the low pressure fuel pump to the high pressure fuel pump by way of the check valve part and the orifice part.

6. The fuel supply apparatus for a GDI engine having reduced pressure pulsation according to claim 1, wherein a relief valve mounted on the fuel supply line is configured to open when the fuel pressure of the fuel supply line between the low pressure fuel pump and the pressure sensor is higher than a preset opening pressure of the relief valve, thereby allowing the fuel to return to the fuel tank so the fuel pressure of the fuel supply line is lowered.

7. The fuel supply apparatus for a GDI engine having reduced pressure pulsation according to claim 6, wherein the opening pressure of the relief valve is set higher than a discharge pressure range of the low pressure fuel pump.

8. The fuel supply apparatus for a GDI engine having reduced pressure pulsation according to claim 7, further comprising a check valve that is installed at an outlet of the low pressure fuel pump, wherein the opening pressure of the relief valve is set higher than an opening pressure of the check valve which allows the check valve to open, and the opening pressure of the check valve part is set higher than the opening pressure of the pulsation relief valve which allows the check valve part of the pulsation relief valve to open.

9. The fuel supply apparatus for a GDI engine having reduced pressure pulsation according to claim 1, further comprising a controller that is installed between the ECU and the low pressure fuel pump, wherein the ECU is configured to compare a current fuel pressure measured by the pressure sensor with a target fuel pressure of the fuel supply line which is measured by the ECU, and to output the target fuel pressure to the controller, so the controller controls a pressure of the fuel which is discharged from the low pressure fuel pump.

* * * * *